United States Patent [19]

Carlini

[11] 4,419,046

[45] Dec. 6, 1983

[54] HIGH PRESSURE CENTRIFUGAL FLUID DELIVERY MACHINE

[76] Inventor: Gerardo P. V. Carlini, Gavilan no 4552, Buenos Aires, Argentina

[21] Appl. No.: 110,858

[22] Filed: Jan. 10, 1980

[30] Foreign Application Priority Data

May 9, 1979 [AR] Argentina ..... 37454

[51] Int. Cl.[3] ..... F04B 27/00

[52] U.S. Cl. ..... 415/127; 415/157

[58] Field of Search ..... 415/120, 127, 128, 154, 415/157, 158

[56] References Cited

U.S. PATENT DOCUMENTS

| | | | |
|---|---|---|---|
| 1,743,916 | 1/1930 | Hargis | 415/128 |
| 1,753,754 | 11/1929 | Hargis | 415/128 |
| 2,178,405 | 10/1939 | Reggio | 415/127 X |
| 3,217,655 | 11/1965 | Sercy et al. | 415/145 X |
| 4,265,592 | 5/1981 | Carlini | 415/157 |

FOREIGN PATENT DOCUMENTS

| | | | |
|---|---|---|---|
| 53-24602 | 3/1978 | Japan | 415/158 |
| 602299 | 5/1945 | United Kingdom | 415/126 |
| 1032938 | 6/1966 | United Kingdom | 415/157 |

*Primary Examiner*—Philip R. Coe
*Assistant Examiner*—Frankie L. Stinson
*Attorney, Agent, or Firm*—Michael J. Striker

[57] ABSTRACT

Centrifugal high-pressure machine comprising an impeller blade rotor positioned within a housing and a spiral chamber surrounding the housing and forming with the blade rotor a diffuser chamber. The machine is provided with an axially movable piston member which with an outer wall and an enclosure member constitutes a chamber of various volume. The chamber is arranged to be connected to the inlet of the machine and to the spiral chamber respectively. The piston member is positioned against a side wall of the blade rotor and has a lateral face congruent with that of the blade rotor. The axial movement of the piston member constitutes diffuser chambers of various geometry and volume.

3 Claims, 2 Drawing Figures

HIGH PRESSURE CENTRIFUGAL FLUID DELIVERY MACHINE

BACKGROUND OF THE INVENTION

Field of the Invention

This invention relates to improvements in fluid delivery machines of the type of high pressure centrifugal pumps and turbo-compressors. It is known in the art that fluid centrifugal delivery machines, such as centrifugal pumps and turbo compressors which act by centrifugal force, of the type under discussion, consist of a frame in which there are formed a central part or housing containing an impeller blade rotor and a peripheral part in the form of a spiral chamber which surrounds the central part and constitutes the communication between the outlet end of the blade and the outlet of the machine. This arrangement normally corresponds to the requirements of pressures and duffuser heads which correspond to the different cross-sections of the head as they approach the outlet of the machine.

As is known, in accordance with the present state of the art, for a given centrifugal machine of the type under discussion, the operating curves of the diffuser chamber are continuous and have an optimal operating zone; the curve of the diffuser head as a function of the delivery output is substantially flat, which results in a considerable change in the output for small changes in the total head. This is not true for the curve of the efficiency as a function of the delivery, which shows a fully defined maximum which determines that if a better efficiency is desired, it is necessary to operate the machine with a given delivery and head, and thus there is no flexibility in the operating range of the machine with which the invention is concerned.

By the incorporating of the improvements provided in the invention it is possible to modify the geometry of the efficiency curves, making them discontinuous; in other words, making them with points of inflection or with zones of different curvature. Such an arrangement can make the operating conditions of a given machine flexible, which cannot be achieved with this type of machine in conventional structures.

SUMMARY OF THE INVENTION

It is an object of this invention to improve the operating characteristics of centrifugal pumps and turbo compressors by providing diffusor chambers of variable volumes and geometry.

Another object of this invention is to provide an improved centrifugal machine with flexible operating conditions.

These and other objects of the invention are achieved by an arrangement comprising an annular piston member disposed within the housing. This annular piston member includes a lateral wall positioned against a side wall of the impeller rotor and having a configuration congruent with that of said side wall. The arrangement includes an annular enclosure member communicating with the inlet of the impeller rotor and an outer wall extending between the spiral chamber of the machine and said annular enclosure to form a chamber of variable volume. The annular piston member is arranged in the device to be movable in an axial direction with respect to the rotor so that the diffusor chamber formed between the spiral chamber and the rotor is of various geometry and volume.

DETAILED DESCRIPTION OF THE INVENTION

Figure 1:
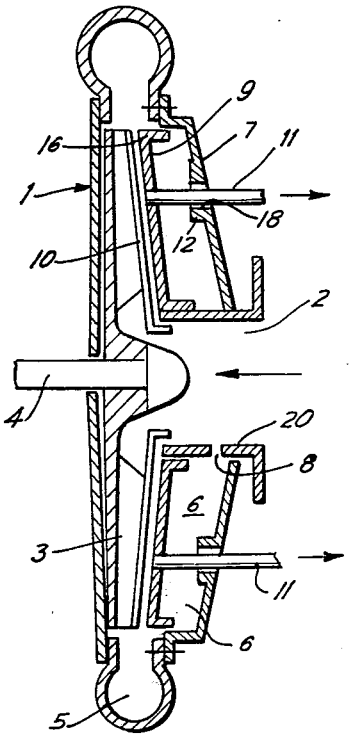
FIG. 1 is a longitudinal section through a fluid delivery machine based on centrifugal action, in accordance with the present invention.

A centrifugal pump in accordance with a preferred embodiment of the invention includes a housing 1 having an axial fluid inlet mouth 2, an impeller blade rotor 3 being provided in said housing 1. The impeller rotor 3 is mounted on a shaft 4 the axis of which coincides with the axis of the inlet 2. A spiral chamber 5 surrounds the housing. Chamber 5 is formed with a section which increases in direction towards the outlet mouth of the pump, which is known in the art.

A partition 7 is provided between the inner directrix of the spiral chamber 5 and a cylindrical enclosure 20 arranged at the inlet 2, which constitutes a chamber or space 6 which surrounds the inlet 2 and extends laterally of the impeller rotor 3 having a side wall 10. The chamber or space 6 communicates with the inside of the inlet 2 by a plurality of orifices 8 located adjacent to the connection of the enclosure 20 with the partition 7.

An annular piston 9 is slidably arranged in a chamber 6 and has a lateral wall 16 positioned against the side wall 10 and being of a shape which is congruent with the shape of the side wall 10 of the impeller blade rotor 3. The annular piston 9 is provided with operating rods 11 which extend through an opening 18 provided in stuffing boxes 12 formed in partition 7 outside of the same. Stuffing boxes 12 may be stuffing boxes extending inwardly into chamber 6 and serving to prevent leakage along the piston member passing through an opening 8 in a chamber or space 6 containing working fluid.

Figure 2:
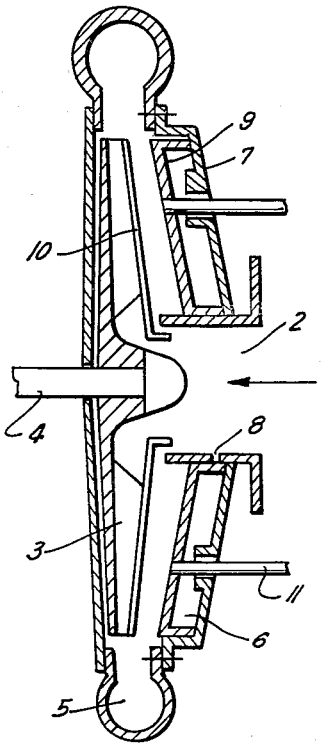
FIG. 2 is a view similar to the FIG. 1, but showing one of the possible positions of the means shaping the variable diffusor chamber.

In operation, by actuating the operating rods 11 it is possible to place the piston member 9 in different positions between that shown in FIG. 1 and that shown in FIG. 2. In operation the fluid admitted into the inlet 2 is passing through openings 8 into chamber 6 and from there into spiral chamber 5. By moving the operating rods the volume of the diffuser chamber formed between wall 10 and wall 16 can be varied. Every position of the piston member 9 provides a different diffuser chamber having a different operating curve, whether with continuous geometry or with discontinuous geometry without modifying the formal or mechanical characteristics of the machine.

Tests carried out with a centrifugal pump having the structure in accordance with the invention have made it possible to verify what has been stated above, since variations in the head have been obtained while maintaining the delivery constant in accordance with the position of the piston 9, which changes the volume of the space or chamber 6 and finally of the chamber which is formed laterally of the rotor 3, as shown in FIG. 2.

This chamber acts by supplementing the spiral chamber 5 in such a manner that its volume can be varied as desired, thereby modifying the hydraulic characteristics of the machine.

It will be understood that each of the elements described above, or two or more together, may also find a useful application in other types of constructions differing from the types described above.

While the invention has been illustrated and described as embodied in an arrangement for a centrifugal pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a centrifugal fluid delivery machine such as centrifugal pumps or turbo-compressors of the type including a housing, an impeller blade rotor coaxially positioned with an axial inlet of the machine for delivery fluid to the rotor, and a spiral chamber surrounding said housing and communicating an outlet end of the blades of the impeller blade rotor with an outlet of the machine, said impeller blade rotor being formed with an inclined side wall to constitute with said spiral chamber an operating diffusor chamber, the combination comprising: an annular piston member disposed within said housing, said annular piston member including a lateral wall positioned against said side wall of the rotor and having a configuration congruent with that of said side wall, an annular enclosure member formed with an opening communicating with said axial inlet, an outer wall extending between said spiral chamber and said annular enclosure member to form an additional chamber therebetween; and actuating means for moving said annular piston and thus said lateral wall in the axial direction to and from said inclined side wall, said lateral wall of said piston member being so arranged that when said actuating means move said piston in said axial direction to and from said side wall, said lateral wall opens or closes said opening, respectively, and connects said additional chamber to or disconnects said additional chamber from said diffusor chamber respectively, whereby the volume of said diffusor chamber is varied in dependence upon a position of said piston member while maintaining fluid delivery from said inlet constant.

2. The centrifugal fluid delivery machine of claim 1, wherein said actuating means include at least one operating rod extending outside of said housing through said outer wall.

3. The centrifugal fluid delivery machine of claim 2, wherein said outer wall is provided with a stuffing box for said operating rod to prevent leakage along said operating rod.

* * * * *